United States Patent [19]

Wipf

[11] Patent Number: 4,901,047

[45] Date of Patent: Feb. 13, 1990

[54] MAGNETIC FIELD TRANSFER DEVICE AND METHOD

[75] Inventor: Stefan L. Wipf, Hamburg, Fed. Rep. of Germany

[73] Assignee: Astronautics Corporation of America, Milwaukee, Wis.

[21] Appl. No.: 307,365

[22] Filed: Feb. 6, 1989

[51] Int. Cl.[4] ..... H01F 7/22

[52] U.S. Cl. ..... 335/216; 335/299

[58] Field of Search ..... 335/216, 299, 296; 336/DIG. 1

[56] References Cited

U.S. PATENT DOCUMENTS

| | | | |
|---|---|---|---|
| 3,361,998 | 1/1968 | Thomas et al. | 335/216 |
| 3,568,116 | 3/1971 | Sole | 335/216 |
| 3,602,854 | 8/1971 | Kawabe et al. | 335/216 |
| 4,190,817 | 2/1980 | Rabinowitz | 335/216 |

OTHER PUBLICATIONS

Wipf, S. L., "Superconductive Energy Storage", National Aeronautics and Space Administration, Sep. 1973, Report No. NASA TT F-15, 109, pp. 1-41.

Wipf, S. L., "Reversible Energy Transfer Between Inductances", from Energy Storage, Compression, and Switching (1976), pp. 469-475.

Smith, P. F., "Synchrotron Power Supplies Using Superconductive Energy Storage", Proceedings of the Second International Conference on Magnet Technology.

*Primary Examiner*—George Harris

*Attorney, Agent, or Firm*—Lathrop & Clark

[57] ABSTRACT

A magnetic field transfer device includes a pair of oppositely wound inner coils which each include at least one winding around an inner coil axis, and an outer coil which includes at least one winding around an outer coil axis. The windings may be formed of superconductors. The axes of the two inner coils are parallel and laterally spaced from each other so that the inner coils are positioned in side-by-side relation. The outer coil is outwardly positioned from the inner coils and rotatable relative to the inner coils about a rotational axis substantially perpendicular to the inner coil axes to generate a hypothetical surface which substantially encloses the inner coils. The outer coil rotates relative to the inner coils between a first position in which the outer coil axis is substantially parallel to the inner coil axes and the outer coil augments the magnetic field formed in one of the inner coils, and a second position 180° from the first position, in which the augmented magnetic field is transferred into the other inner coil and reoriented 180° from the original magnetic field. The magnetic field transfer device allows a magnetic field to be transferred between volumes with negligible work being required to rotate the outer coil with respect to the inner coils.

15 Claims, 6 Drawing Sheets

MAGNETIC FIELD TRANSFER DEVICE AND METHOD

The Government has rights in this invention pursuant to Contract No. W-7405-ENG-36 awarded by the U.S. Department of Energy.

FIELD OF THE INVENTION

This invention pertains generally to apparatus and methods for producing magnetic fields, and particularly to the manner in which a magnetic field can be transferred between volumes.

BACKGROUND OF THE INVENTION

Various methods and devices have been used for transferring magnetic fields between different volumes. Magnetic field transfer devices may be utilized in inductive energy storage systems and in magnetic refrigeration devices. To accomplish a transfer of flux from one volume to another in a reversible and (substantially) lossless manner, several basic principles must be considered. First, the flux in a closed circuit should remain unchanged during any transient process. Second, according to the principle of least action, the difference between two complementary forms of energy integrated over the duration of the dynamic process should be minimized. If one of the energies is magnetic, the other energy may be kinetic or potential mechanical energy, electromechanical energy, and so forth. In electrodynamics, magnetic energy and electrostatic energy are complementary. Third, to ensure reversibility of the transfer process, there should be substantially no entropy production.

Capacitors often are connected in parallel with magnetic coils for use as a transfer element during inductive transfer between the coils. However, such a transfer element generally is required to accommodate about half the initial energy of the first coil in a complementary form during the transfer, in accord with the principle of least action. The initial energy is stored in the magnetic field of the coil and the complementary energy is stored in the electric field of the capacitor. Capacitors are quite limited in the amount of energy which they are able to store, and therefore may not be suitable for use as a transfer element in many applications.

Various methods for transferring magnetic fields are discussed in S. L. Wipf, "Reversible Energy Transfer Between Inductances", in *Energy Storage, Compression and Switching,* (book), Plenum Publishing Company, New York, N.Y., 1976, pp. 469–475. One system described in this article has a liquid metal homopolar transfer element in which a magnetohydrodynamic (MHD) medium flows at right angles to a magnetic field and to the current flow. The missing magnetic energy during transfer is converted into the kinetic energy of the liquid metal. Thus kinetic energy is employed to store the magnetic energy difference in a complementary form during transfer; the device therefore acts in the same way as a capacitor. It has an effective capacity proportional to the density of the medium and to $1/B^2$. A second system described achieves magnetic field transfer by the rotation of a shorted inductance coil magnetically coupled to a coupling coil which is part of a load circuit with at least one other coil. From the initial state of maximum coupling the movable shorted inductance coil is rotated and thus its coupling is reduced. The reduction of the coupling causes a transfer of energy from one coil to the other coil of the load circuit and subjects the rotating coil to an accelerating torque. When the coupling is zero the kinetic energy of the rotating coil is at its maximum; further rotation increases the coupling in the negative direction, decelerating the rotating coil. The transfer is completed and the rotating coil comes to rest when the coupling is again at maximum but in the opposite direction.

These transfer devices, where kinetic energy is used, instead of the electrostatic energy of a capacitor, can be much more compact than equivalent capacities. However, the containment of the mechanical forces, and especially the accelerating and decelerating forces, can pose uncommon design problems.

As a special case it is possible to make rotating inductive transfer elements where the sum of the magnetic energy stored in all the inductances is constant during the transfer. There is no necessity to be able to store kinetic energy during transfer.

Such a device is described in P. F. Smith, "Synchrotron Power Supplies Using Superconductive Energy Storage", Proceedings of the Second International Conference on Magnet Technology, 1967, pp. 589–593. The disadvantage is that the transfer element must be capable of storing, inductively, twice as much energy as the inductances between which the magnetic field is transferred. Smith also describes another device which is equivalent to a mechanically coupled motor and dynamo connected to an energy storage coil magnet and a synchrotron coil magnet.

SUMMARY OF THE INVENTION

The present invention allows magnetic field transfer in an arbitrary time interval between inductances in proximity. A magnetic field transfer device in accordance with the present invention includes a pair of inner coils which comprise two equal coplanar inner loops electrically connected together so that any current which moves in one rotational direction around one inner loop moves in the opposite rotational direction around the other inner loop, and an outer coil which is comprised of an outer loop which is outwardly positioned from the inner coils and rotatable in relation to the two inner loops between two positions 180° apart in which the outer loop is coplanar with the inner loops. The inner and outer coils may be superconducting. Since the two inner loops conduct current in opposite directions, substantially no current is induced in the inner loops by any external magnetic field in which the inner loops lie, which has equal magnetic fluxes linked with both of the inner loops. When the outer loop is rotated 180° from its first coplanar position to its second coplanar position, the magnetic field which is located within one inner loop is transferred to the other inner loop and reoriented 180°.

A second magnetic field transfer device of the invention includes a pair of oppositely wound inner solenoidal coils and an outer solenoidal coil which is outwardly positioned from the two inner coils and rotatable relative to the inner coils. Each inner coil preferably includes superconducting windings around an inner coil axis. The two inner coil axes are parallel and laterally spaced from each other so that the inner coils are positioned in side-by-side relation. Each inner coil may form an inner cylinder which is D-shaped in cross-section and which has an inner cylindrical axis perpendicular to the inner coil axis. As used herein, the coil axis is a straight line at the center of and parallel to the magnetic field of the coil. The windings of each inner coil are wound to run substantially in two opposite directions parallel to the inner cylindrical axis. Each inner cylinder includes a straight central wall formed of the windings through which current can flow in a first direction parallel to the inner cylindrical axis, and a curved outer wall through which current can flow in an opposite direction parallel to the inner cylindrical axis. The windings in the central wall and outer wall of each inner cylinder are joined together at the ends of each inner cylinder so that the windings forming each inner cylinder are continuous. The straight inner walls of the two inner cylinders are adjacent to each other so that a circular outer surface is formed by the two curved outer walls of the inner cylinders.

The outer solenoidal coil preferably includes superconducting windings around the outer coil axis and forms an outer cylinder with an outer cylindrical axis perpendicular to the outer coil axis. The outer coil is rotatable about the two inner coils around a rotational axis which is substantially perpendicular to the inner and outer coil axes. The outer cylinder includes two substantially semi-cylindrical walls. Current can flow through the first semi-cylindrical walls in a first direction parallel to the outer cylindrical axis, and through the second semi-cylindrical wall in an opposite direction parallel to the outer cylindrical axis. The windings in the two semi-cylindrical walls are joined together at the ends of the outer cylinder so that the windings forming the outer cylinder are continuous. When the outer coil axis is parallel to the inner coil axes, the magnetic field of the outer coil augments the magnetic field of one of the inner coils and diminishes the other. Preferably, one magnetic field is doubled in strength, while the other is diminished to zero. When the outer coil then is rotated 180° around the inner coils, the augmented magnetic field is transferred from the one inner coil to the other inner coil and reoriented 180°.

A third magnetic field transfer device of the invention is similar to the second device, except that the inner coils each form an inner cylinder with a circular instead of D-shaped cross-section.

The magnetic field transfer devices are capable of transferring magnetic fields between volumes which are very close to each other. With these devices, the magnetic field transfer can be accomplished with negligible energy losses, and with reversibility. Generally, the back electromotive force (EMF) within the coils during operation is substantially zero, so that the work required to turn the outer coil is negligible. The volumes which contain the magnetic fields may take substantially any shape, and the coils may be arranged to accommodate a magnetic field of any direction.

Further objects, features, and advantages of the invention will be apparent from the following detailed description taken in conjunction with the accompanying drawings.

DESCRIPTION OF THE PREFERRED EMBODIMENT

Figure 1:
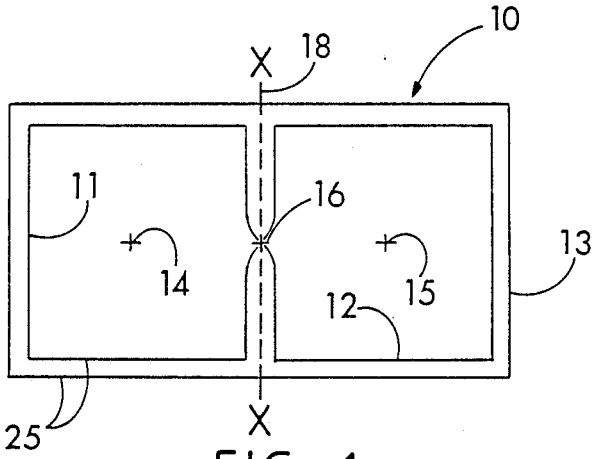
FIG. 1 shows a first magnetic field transfer device in accord with the invention.
Figure 2:
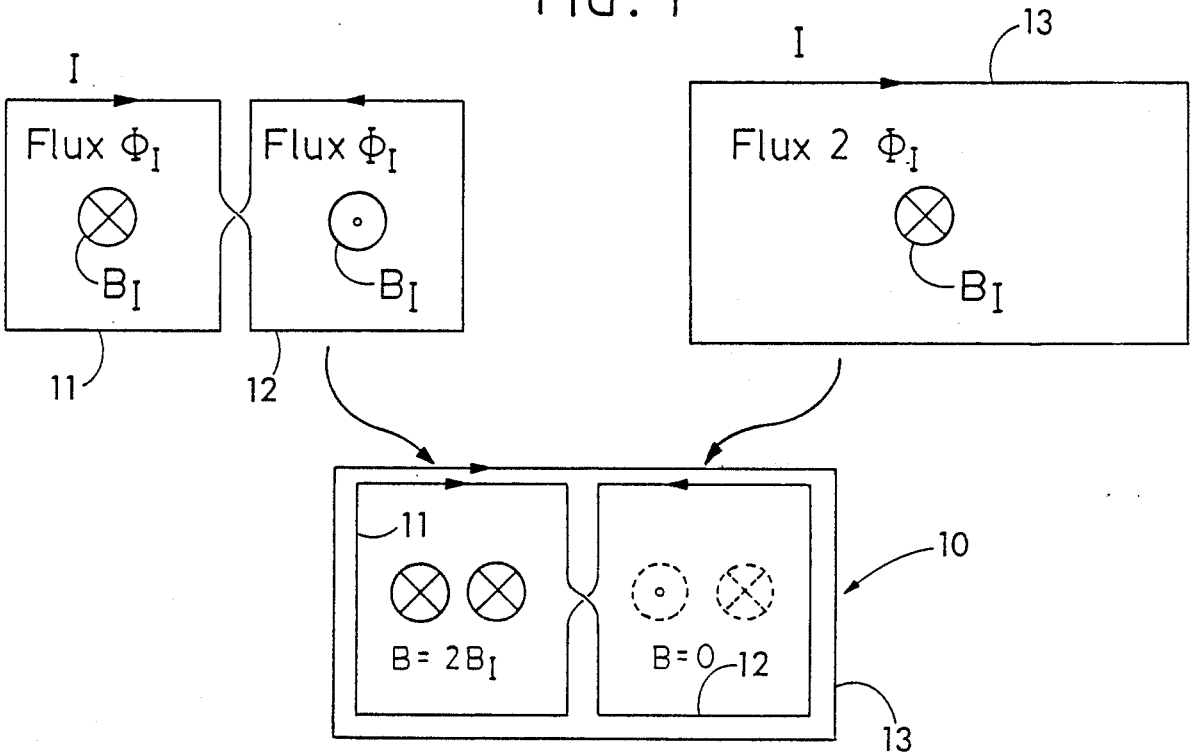
FIG. 2 shows the manner in which the two inner loops and the single outer loop of the first magnetic field transfer device are combined.
Figure 3:
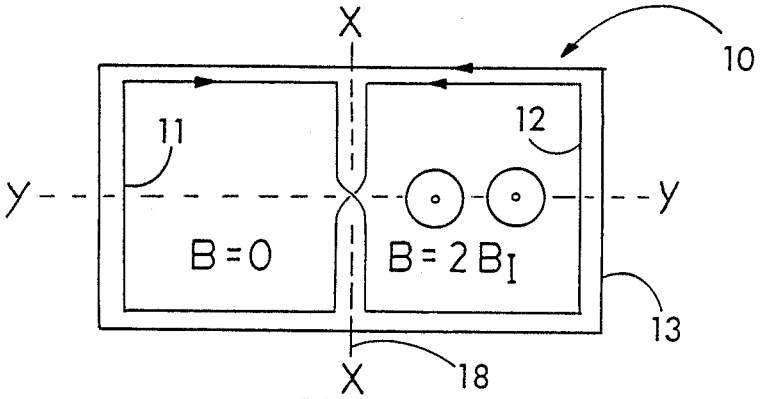
FIG. 3 shows the first magnetic field transfer device after the outer loop has been rotated 180° from the position shown in FIG. 2, such that the augmented magnetic field has been transferred from the left inner loop to the right inner loop and is reoriented 180°.

Referring to the drawings, FIGS. 1-3 show a first magnetic field transfer device 10 which is fairly simple in structure and yet may be used to transfer a magnetic field from one volume to another volume. Although the fields within the loops of this device are not nearly uniform, this simple embodiment is useful in illustrating the principles of the invention. As shown, the first device 10 includes two rectangular coplanar inner loops 11 and 12 which are dimensioned identically, and an outer loop 13 which is dimensionally large enough to encircle the two inner loops 11 and 12. Each inner loop 11 or 12 acts as an inner solenoidal coil of one (e.g., superconducting) winding (or a compact group of windings) around an inner coil axis 14 or 15. The two axes 14 and 15 of the loops 11 and 12 are parallel and laterally spaced from each other so that the loops 11 and 12 are positioned in side-by-side relation. As shown in FIGS. 1-3, the inner loops 11 and 12 are electrically connected together so that any current which moves around one of the inner loops 11 or 12 moves in an opposite rotational direction around the other inner loop 11 or 12. Thus the two inner loops 11 and 12 are wound oppositely about their axes 14 and 15.

The outer loop 13 acts as an outer solenoidal coil of one superconducting winding (or a compact group of windings) around the outer coil axis 16. The outer loop 13 is outwardly positioned from the inner coils 11 and 12 and is rotatable in relation to the two coplanar inner loops 11 and 12 between two positions which are 180° apart and in which the outer loop 13 is coplanar with the two inner loops 11 and 12. When the outer loop 13 is rotated about its axis of rotation 18, which is perpendicular to the inner loop axes 14 and 15, a hypothetical surface which substantially encloses the inner coils 11 and 12 is generated.

If the two oppositely wound inner loops 11 and 12 carry zero current, there is no magnetic flux linked with the double loop 11 and 12. When the inner loops 11 and 12 together are placed alone into any uniform external magnetic field, no current is induced in the inner loops 11 and 12. Thus the inner loops 11 and 12 together are a magnetic gradiometer which does not react to changes in the magnetic field, as long as the magnetic field changes are equal in both loops 11 and 12. The two loops 11 and 12 together act as a magnetic gradiometer not only when the external field is uniform, but also when the magnetic fluxes, due to the external magnetic field, are equal in each loop 11 and 12. Therefore current is not induced in the loops 1 and 12 as long as the following condition is met:

$$\int \int_a B_{ext} df = \Phi_a = \int \int_b B_{ext} df = \Phi_b$$

where "a" and "b" refer to the area enclosed by the loop 11 and the loop 12, respectively.

A change in current within the loops 11 and 12 will occur if there are different magnetic fluxes through the loops 11 and 12. Normally this will not occur.

As shown in FIG. 2, if the current I is present in the two inner loops 11 and 12 alone, the magnetic fields (each $B_I$) through the loops 11 and 12 are directed oppositely through the inner loops 11 and 12. FIG. 2 shows the magnetic field $B_I$ in the left inner loop 11 directed downwardly into the page, and the magnetic field $B_I$ in the right inner loop 12 directed upwardly from the page. Each of these two oppositely directed magnetic fields cause the flux linked with the individual inner loops 11 and 12 to be $\Phi_I$. The flux linked with the two inner loops 11 and 12 is:

$$2\,\Phi_I = \int \int_a B_I df + \int \int_b B_I df.$$

An external field can be produced by a current I in the outer loop alone as shown in FIG. 2. Again, the field strength is $B_I$, and since the area which the outer loop 13 forms is about twice as large as a single inner loop 11 or 12, the flux linked with the outer loop 13 is substantially 2 $\Phi_I$. As shown in FIG. 2, if the two inner loops 11 and 12 and the outer loop 13 are superimposed on each other, the magnetic field in the outer loop 13 doubles the magnetic field strength in the left inner loop 11 and diminishes the magnetic field strength in the right inner loop 12 to substantially zero.

The superposition or addition of the external field created by the outer loop 13 over the two inner loops 11 and 12 does not change the current I in those inner loops 11 and 12. The flux linked with the inner double loop (two inner loops 11 and 12 together) and with the outer loop 13, remains unchanged at 2 $\Phi_I$. As shown in FIG. 3, if the outer loop 13 is rotated around the axis of rotation 18 by 180°, the field in the left inner loop 11 is then zero and the field in the right inner loop 12 is 2 $B_I$, a field which projects out of the page in FIG. 3. Thus the augmented magnetic field is transferred from the left inner loop 11 to the right inner loop 12 when the outer loop 13 is rotated 180°. Additionally, the augmented magnetic field is reoriented 180°. Initially, as shown in FIG. 2, the augmented magnetic field projects directly into the page within the left inner loop 11, while the magnetic field in the right inner loop 12 is cancelled. Thus, the augmented magnetic field is transferred from the left inner loop 11 to the right inner loop 12 as the outer loop 13 rotates 180°, and a converse transfer occurs upon another 180° rotation. Rotation around any other axis of symmetry has the same effect, for example, about the axis y—y of FIG. 3. For a square outer coil, the diagonals would also be possible axis of rotation.

The magnetic field transfer device 10 is a simple device which is particularly effective in demonstrating the principle by which the present invention moves a magnetic field from one volume or location to another and back, with very little work being required. The process is reversible, and any energy loss is small since the back EMF and local eddy currents within the loops are kept to a minimum. Additionally, the first device 10 demonstrates that the volumes in which the process is carried on can be very close to each other. The particular direction of the field, and the shape of the volumes are not critical.

Figure 4:
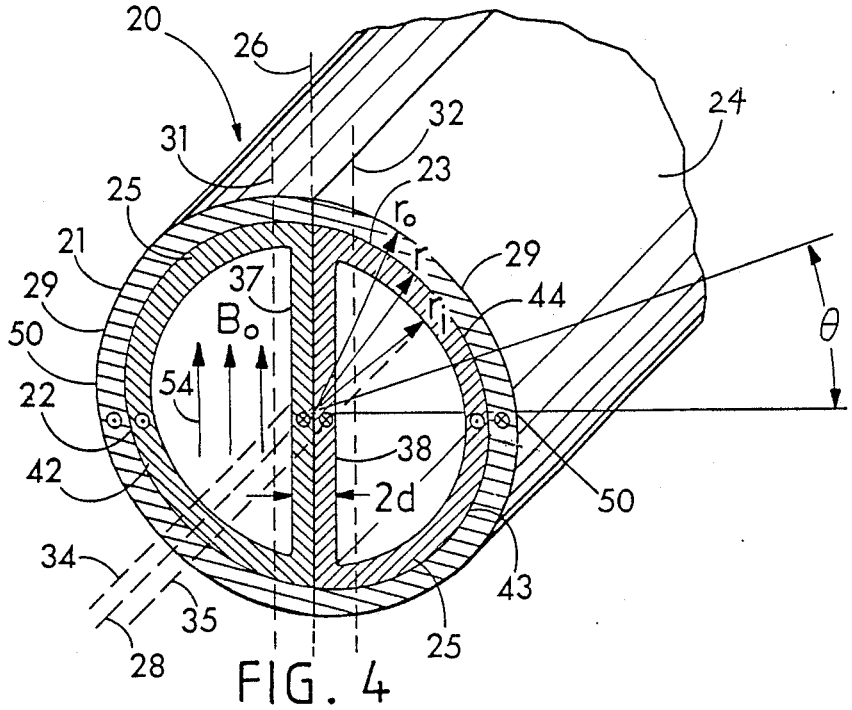
FIG. 4 shows a schematic cross-sectional perspective view of a second magnetic field transfer device of the invention, wherein the cross-section is taken through the center of the device along the coil axes of the inner and outer coils.

A second magnetic field transfer device 20 is shown schematically in FIG. 4. The second device 20 is a preferred embodiment which can be adapted for use with magnetic refrigeration apparatuses to transfer reversibly a magnetic field from one volume to another. As shown in FIG. 4, the second magnetic field transfer device includes an outer solenoidal coil 21 of circular cross-section which substantially encloses two oppositely wound inner solenoidal coils 22 and 23 which each have D-shaped cross-sections. The outer solenoidal coil 21 is a dipole coil formed with preferably superconducting windings 24 (individual turns not shown for clarity of illustration) generally around an outer coil axis 26 between radii $r_O$ and r. A variety of well known superconducting materials and/or composite superconductors can be used for the windings. One such superconductor is niobium −3 tin, which has a zero field critical temperature of approximately 18K. It is understood that superconducting systems require insulating Dewars and refrigeration apparatus, which are well known and conventional. The outer coil 21 is wrapped to form an outer cylinder with an outer cylindrical axis 28 which runs perpendicular to the outer coil axis 26. The windings 24 are wound to run substantially in two opposite directions parallel to the outer cylindrical axis 28 to form two substantially semicylindrical walls 29 as shown in FIG. 4. The windings 24 in the outer coil 21 are wound so that in the left semicylindrical wall 29 the current flows in a first direction parallel to the outer cylindrical axis 28, while in the right semi-cylindrical wall 29 the current flows in an opposite direction also parallel to the outer cylindrical axis 28. The windings 24 of the two semicylindrical walls 29 are joined together at the ends of the outer cylinder so that the windings forming the outer coil 21 are continuous. If current flows through the outer coil 21 parallel to the outer cylindrical axis 28 in both directions with a current distribution proportional to $j_o\cos\theta$ (where $\theta$ is the angle from the origin as shown in FIG. 4), then the outer coil 21 produces a uniform and vertical magnetic field $B_c=(\mu_o/2)j_o(r_o-r)$.

Positioned inside the outer coil 21 are the two inner coils 22 and 23. Each inner coil 22 or 23 is formed with superconducting windings 25 around the inner coil axis at 31 or 32 between radii $r_i$ and r. The two inner coil axes 31 and 32 are parallel and laterally spaced from each other so that the inner coils 22 and 23 are positioned in side-by-side relationship. Each inner coil 22 or 23 is wound to form an inner cylinder with an inner cylindrical axis 34 or 35 perpendicular to the inner coil axis 31 or 32. Each inner cylinder includes a straight central wall 37 or 38 formed of the windings 25 running in a first direction parallel to the inner cylindrical axis 34 or 35, and a curved outer wall 42 or 43 formed of the windings 25 running in the opposite direction which also is parallel to the inner cylindrical axis 34 or 35. Thus, electrical current flowing through the windings 25 of the inner coils 31 and 32 will flow in one direction parallel to the inner cylindrical axis 34 and 35 through the straight central walls 37 and 38, and in the opposite direction through the curved outer walls 42 and 43. As in the outer coil 21, the windings in the central wall 37 or 38 and the outer wall 42 or 43 of each inner coil 22 and 23 are joined electrically together in a conventional manner at the ends of the inner cylinder 22 or 23 so that the windings 25 forming each inner cylinder 22 or 23 are continuous. In the schematic representation of FIG. 4, the straight central walls 37 and 38 of the two inner cylinders 22 and 23 are adjacent to each other so that a circular outer surface 44 is formed by the two curved outer walls 42 and 43 taken together.

As shown in FIG. 4, the magnetic fields formed by each of the two inner coils 22 and 23 alone are $B_a$ and $B_b$, respectively, and the field formed by the outer coil 21 is $B_c$. The outer coil magnetic field $B_c$ augments the left inner coil magnetic field $B_a$ and cancels the right inner coil magnetic field $B_b$ when the outer coil 21 is in its initial position as shown in FIG. 4. Therefore, within the left inner coil 22, the magnetic field $B=2\ B_c=B_O$, while in the right inner coil 23, the magnetic field $B=0$.

The outer cylindrical axis 28 forms a rotational axis for the outer coil 21. When the outer coil 21 is rotated about the inner coils 22 and 23, a hypothetical surface which substantially encloses the inner coils 22 and 23 is generated. If the outer coil 21 is rotated 180° from the position shown in FIG. 4, the augmented magnetic field is shifted from inside the left inner coil 22 to be inside the right inner coil 23. After the 180° rotation, the magnetic field within the left inner coil 22 is $B=0$, while in the right inner coil 23, the magnetic field is $B=-2\ B_c=-B_O$. Thus the outer coil 21, which is spaced slightly outwardly from the inner coils 22 and 23, is rotatable relative to the inner coils 22 and 23 about its rotational axis between a first position where the outer coil axis 28 is substantially parallel to the inner coil axes 31 and 32 and a magnetic field is formed in one inner coil 22 or 23 parallel to its inner coil axis 31 or 32, and a second position where the magnetic field is transferred into the other inner coil 22 or 23 and is reoriented 180°.

Figure 5:
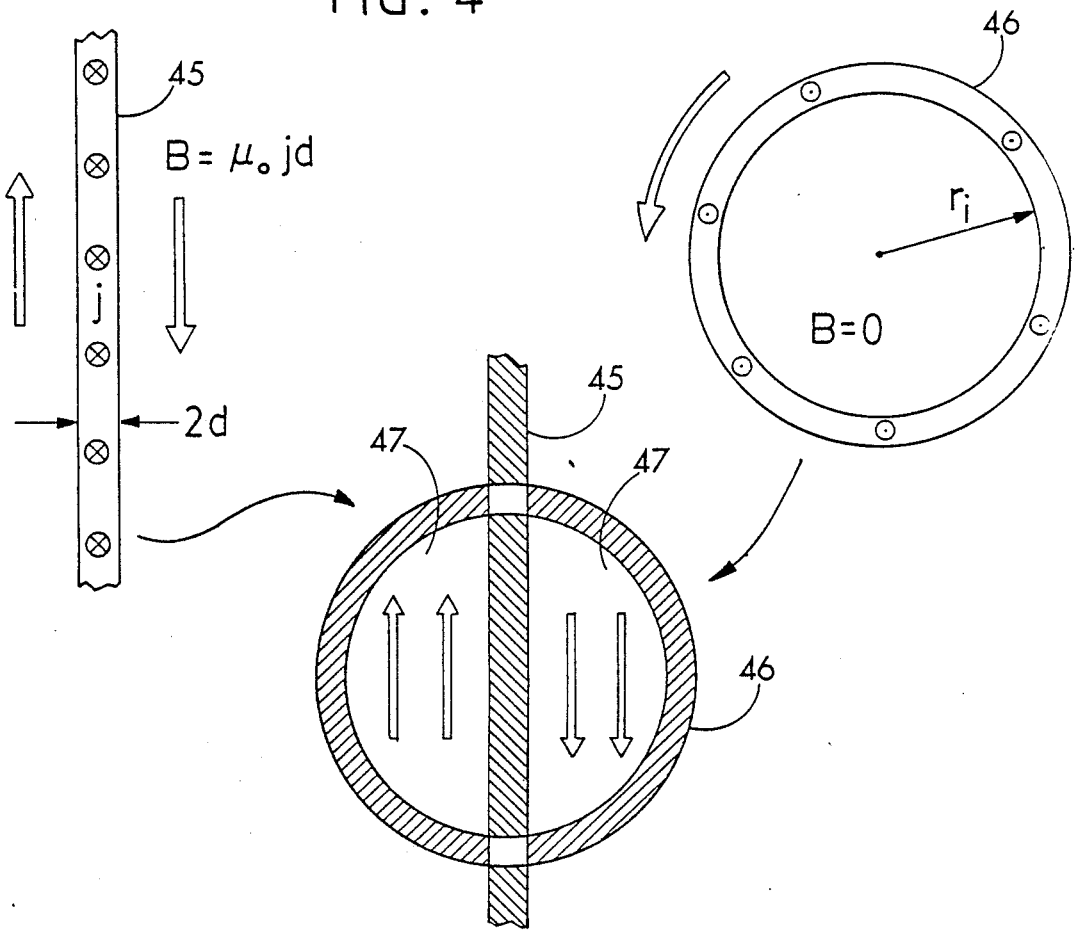
FIG. 5 is an illustrative view showing a plane current sheet and a hollow tube superimposed on each other to illustrate the functioned principles of the inner coils of the device of FIG. 4.
Figure 6:
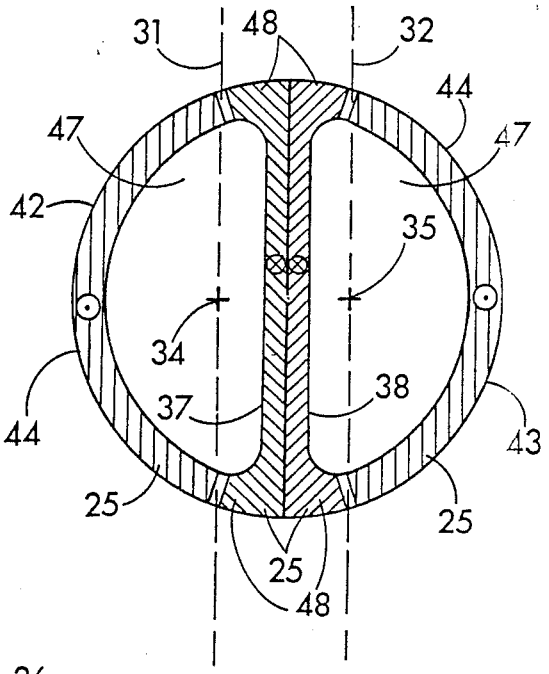
FIG. 6 shows a schematic cross-sectional view of an exemplary structure for the two inner coils of the second magnetic field transfer device.

The structure and function of the two D-shaped inner coils 22 and 23 is explained with reference to FIG. 5. A plane current sheet 45 of thickness *2d*, with current density $j_O$ is shown in the upper left of FIG. 5. Current going rearwardly in the sheet 45 (into the page) produces on either side of the sheet 45 a uniform parallel magnetic field $B=\mu_o j_o d$. As shown in the upper right of FIG. 5, a hollow tube of inner radius $r_i$ with electrical current flowing in a direction upwardly (out of the page) will produce zero magnetic field inside the hollow tube 46. In the lower portion of FIG. 5, the plane current sheet 45 and the hollow tube 46 are superimposed on each other to form two D-shape volumes 47 with equal and opposite uniform fields. The hollow tube 46 carries the return current of a section of the plane sheet 45, and the thickness of the hollow tube 46 is adjusted accordingly. Of course, the plane sheet 45 cannot extend upwardly and downwardly to infinity. The plane sheet 45 is cut off preferably at the outer radius of the hollow tube 46, so that the entire arrangement can fit into the outer coil 21. The field distorting effect of cutting the plane sheet 45 can be alleviated by thickening the edges as shown schematically at 48 in FIG. 6. As shown in FIG. 6, the planar sheet 45 actually becomes the two straight central walls 37 and 38. A theoretically exact winding cross-section can be determined. However, the width of the edges 48 will be determined by a compromise between the level of tolerance of deviations from field uniformity and the desired simplicity of coil construction.

Figure 7:
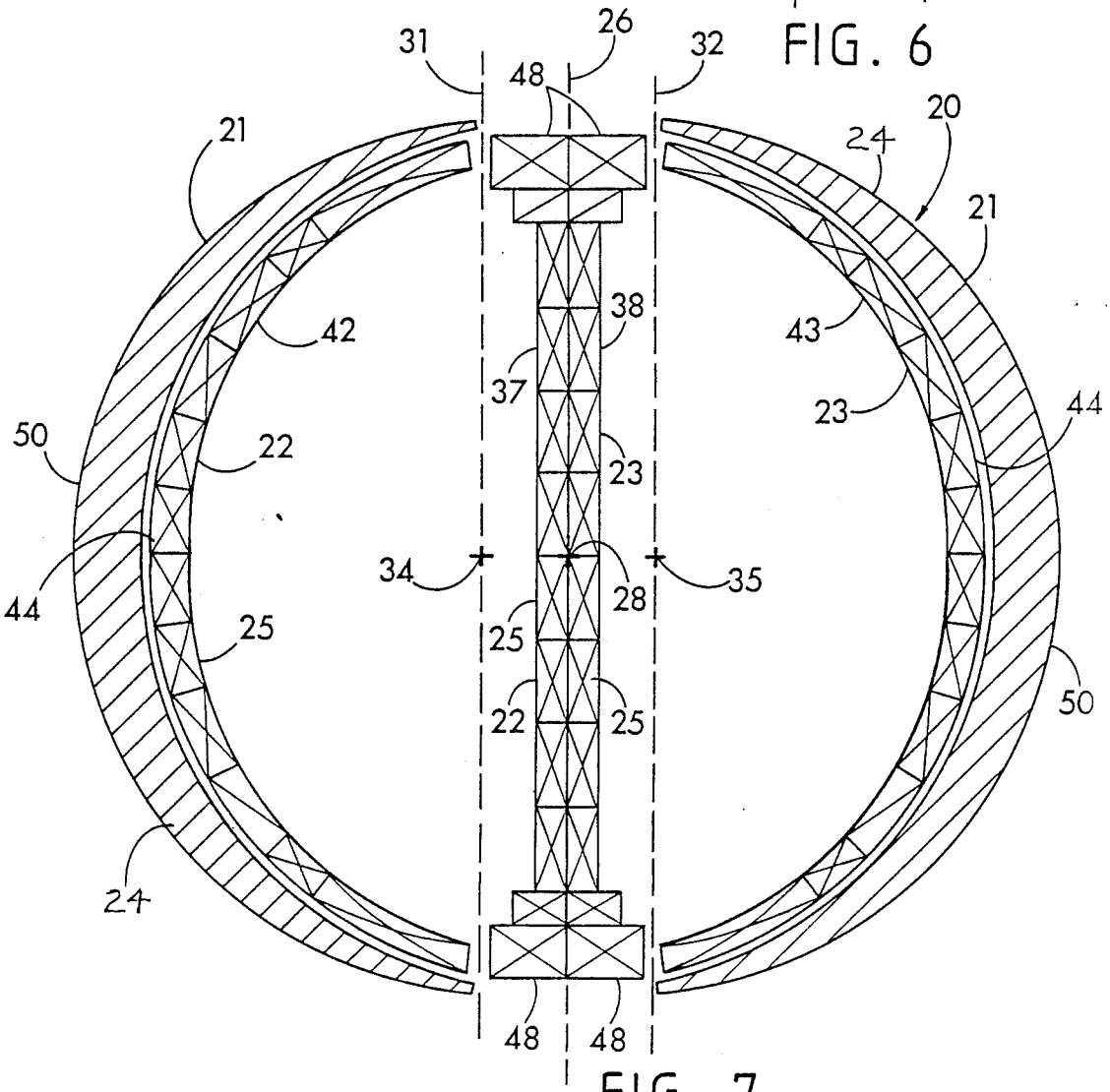
FIG. 7 shows a cross-sectional view of a preferred implementation of the second magnetic field transfer device.

FIG. 7 illustrates a full-sized winding cross-section of the second magnetic field transfer device 20. To illustrate the desired geometry with specific dimensions, the D-shaped inner coils 22 and 23 may have an outside radius $r=78$ mm, and a length of about $L=20$ cm., giving the inner field volume 47 of each inner coil 22 and 23 a volume of about 0.0014 $m^3$. If an augmented magnetic field $B_o=6$ Tesla (T) is obtained using a superconductor with critical current density $j_{c\ s.c.}=2\times10^9$ $A/m^2$, then the thickness of each of the straight central walls 37 and 38 will be $d=0.6$ cm. and the thickness of the thickest part of the outer coil 21 will be $r_o-r=1.2$ cm. The overall current density in the windings is $j_o=\lambda j_{c\ s.c.}=4\times10^8$ $A/m^2$, where $\lambda=0.2$ is the ratio between the cross-section of the superconductor material and the entire structure of the windings 25 including the copper, insulation, other structure, and the coolant space. Such a device 20 will have a stored energy (14.32 $MJ/m^3$) of 20 kJ. As shown in FIG. 7, the outer coil 21 semicylindrical walls 29 are each tapered as they approach the outer coil axis 26. This allows the current to be distributed throughout the outer coil 21 in proportion to cos $\theta$, as stated earlier. The angle $\theta$ is an angle formed between any point on the semicylindrical walls 29 and a midpoint 50 of the semicylindrical wall 29, with respect to the outer cylindrical axis 28.

The torque on the outer coil 21 during rotation will be about zero. The energy of a coil system consisting of two hypothetical coils I and II is $W_{I,II}=(\frac{1}{2})L_I I_I^2+(\frac{1}{2})L_{II}I_{II}^2+M_{I,II}I_I I_{II}$ where L and M are the self and mutual inductances. If coil I is taken to be the outer coil 21, and coil II is taken to be the two inner coils 22 and 23 in series opposition, it can be demonstrated that $W_{I,II}$ is independent of the angle of position ($\alpha$) between the outer coil 21 and the two inner coils 22 and 23. The angle $\alpha$, as shown in FIGS. 8–12, is the angle which the outer coil axis 26 forms with the line 52 which runs perpendicular to the outer cylinder axis 28 between the two straight central walls 37 and 38 of the coils 22 and 23. The mutual inductance between the outer coil 21 and the inner coils 22 and 23 is obtained by the formula $M_{I,II}=M_{ac}-M_{bc}+M_{ca}-M_{cb}=2M_{ac}-2M_{bc}$. Half of the terms are subtracted because the inner coils 22 and 23 are in opposition to each other. The inner coils 22 and 23 are always in symmetrical positions relative to the outer coil 21. Therefore, $M_{ac}=M_{bc}$, and $M_{I,II}=0$. Since $M_{I,II}=0$, the currents $I_I$ and $I_{II}$ are independent of each other and are both constant if the superconducting coils are all in a persistent mode. Therefore the torque $\tau=\delta W_{I,II}/\delta\alpha=0$. This result is true only if L and M are independent of the magnetic field. In some applications this may not be true.

In such cases, inductances are no longer purely a function of geometry, bu also of the field. Therefore although the inner coils 22 and 23 are still always in symmetrical positions with respect to the outer coil 21, they also are in different fields. A small difference in inductance therefore will cause a torque requiring some work during rotation of the outer coil 21.

Just like in any other electromagnet, there are static forces operating on the structure of each coil 21, 22, and 23. The winding structure forming the straight central walls 37 and 38 and the curved outer walls 42 and 43 must be strong enough to contain these forces. Any unbalanced forces between the coils 21, 22 and 23 will be transmitted by conventional rotation bearings which support the rotating outer coil 21.

Figure 8:
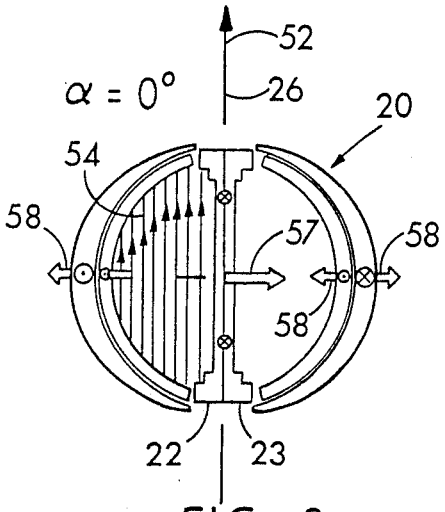
FIG. 8 shows a schematic cross-sectional view of the second magnetic field transfer device with the outer coil axis aligned with the straight central walls of the inner cylinders so that $\alpha=0$, where $\alpha$ is the angle between the axes of the inner and outer cylinders.
Figure 9:
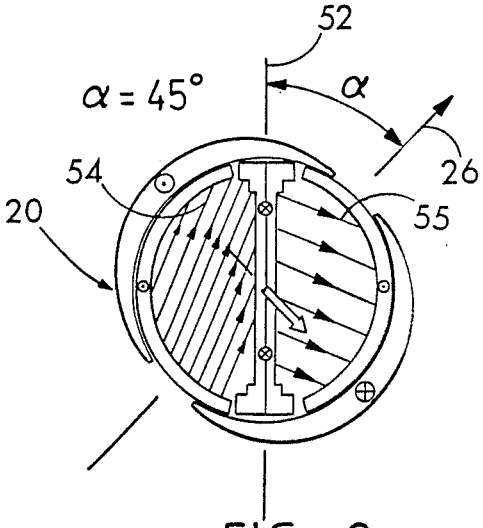
FIG. 9 shows a schematic cross-sectional view of the second magnetic field transfer device with the outer coil rotated so that $\alpha=45°$.
Figure 10:
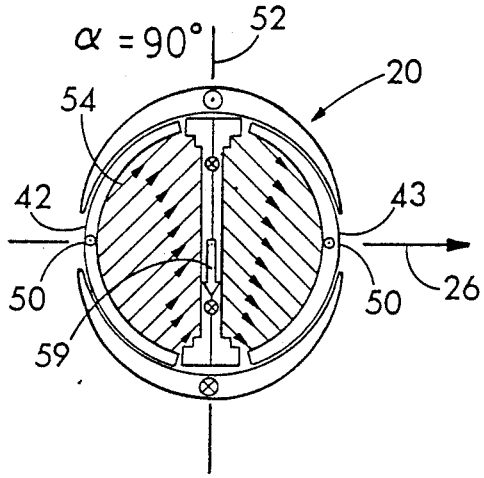
FIG. 10 shows a schematic cross-sectional view of the second magnetic field transfer device with the outer coil rotated so that $\alpha=90°$.
Figure 11:
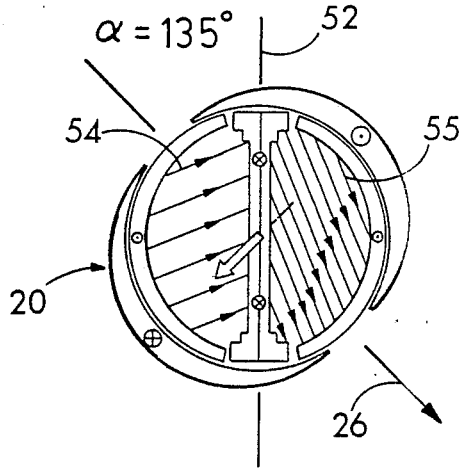
FIG. 11 shows a schematic cross-sectional view of the second magnetic field transfer device with the outer coil rotated so that $\alpha=135°$.
Figure 12:
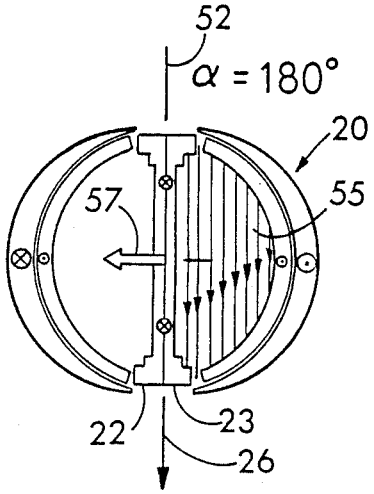
FIG. 12 shows a schematic cross-sectional view of the second magnetic field transfer device with the outer coil rotated so that $\alpha=180°$.
Figure 13:
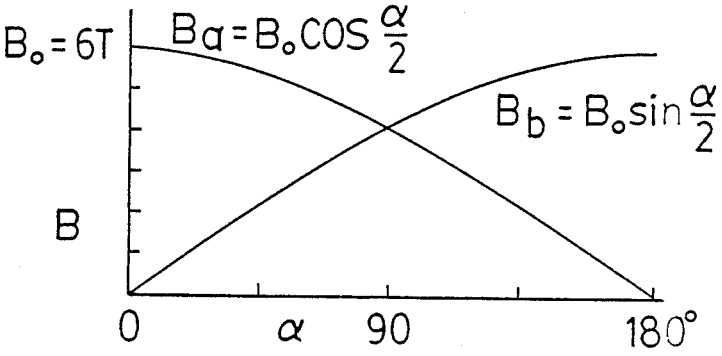
FIG. 13 shows a graph of the magnetic field strengths in the left and right inner coils of the second magnetic field transfer device as a function of the angle $\alpha$.

FIGS. 8–12 show schematically the magnetic fields in the left inner coil 22 (the field designated generally by the numeral 54) and in the right inner coil 23 (designated generally by the numeral 55), and the static forces which operate upon the straight central walls 37 and 38, curved outer walls 42 and 43, and the semi-cylindrical walls 29 of the outer coil 21. FIG. 13 shows the field strength in Teslas (T) for the magnetic field 54 ($B_a$) in the left inner coil 22 and the magnetic field 55 ($B_b$) in the right inner coil 23 for the structure of FIG. 7 with the foregoing exemplary dimensions. As shown, the magnetic field 54 in the left inner coil 22 is $B_a=B_o\cos\alpha/2$, and the magnetic field 55 in the right inner coil 23 is equal to $B_b=B_o\sin\alpha/2$. As shown in FIG. 9, the field lines 54 in the left inner coil 22 are slanted at the angle $\alpha/2$.

At 6 Teslas, the magnetic pressure is 14.3 megapascals (MPa). Therefore the force 57 on the straight central walls 37 and 38 in FIGS. 8 and 12 will be about 500 kiloNewtons (kN) for the exemplary device of FIG. 7. If possible, these forces 57 are best handled by tension and compression members between the straight central wall 37 or 38 and the curved outer wall 42 or 43 of each inner coil 22 or 23. As shown in FIG. 8, there exists a constant field between the outer coil 21 and the two inner coils 22 and 23 which is equal to 3 Teslas, and which corresponds to 3.6 MPa of magnetic pressure, or a total force 58 of about 143 kN between those coils 21, 22 and 23. This force 58 can be resisted easily by an outside structure around the outer coil 21 such as an iron flux return path. For $\alpha=90°$, the total current of 0.9 MA in the straight central walls 37 and 38 in the 3 Tesla field of the outer coil 21 will produce a deforming force 59 of about 520 kN. Special attention is required in the designing of the structure of the inner coils 22 and 23 to accommodate such a formidable force 59. Fortunately, the balancing forces on the rotational bearings holding the outer coil 21 will be approximately 0, because M=0. However, the flux return structure (iron) will influence the fields in a gap between the outer coil 21 and the two inner coils 22 and 23, thus creating unbalancing forces. Generally, the fields thereby created should be less than 1 Tesla and therefore will produce bearing forces of not more than about 10 kN.

In its operation, the second magnetic field transfer device 20 transfers a magnetic field from the inside of one inner coil to the inside of the other inner coil in a reversible process with substantially no back EMF and no torque during rotation of the outer coil 21. A transfer of the magnetic field from the left inner coil 22 to the right inner coil 23 is demonstrated in FIGS. 8–12. For initial charging, the coils 21, 22 and 23 are connected to a source of electric current which flows through the coils as shown. After charging to the required current, the superconducting coil may be put into a persistent mode (that is, the beginning and end of the winding are superconductively connected to each other). In many cases of practical application the required current is such that the minimum field in the coil 22 or 23 is zero. Electrical current flows rearwardly through the straight central walls 37 and 38 and forwardly through the curved outer walls 42 and 43. The two inner coils 22 and 23 should be connected together electrically so that their current flows in opposite directions. In the outer coil 21, the current flows rearwardly through the right semicylindrical wall 29 and forwardly through the left semicylindrical wall 29. As the outer coil 21 rotates, the left magnetic field 54 is equal to $B_a=B_0\cos\alpha/2$, and the right magnetic field 55 is equal to $B_b=B_0\sin\alpha/2$ as shown in FIG. 13.

As the outer coil 21 is rotated from its position shown in FIG. 8, the magnetic field 54 in the left inner coil 22 begins to weaken, and also rotates at half the angular velocity of the outer coil 21. Thus if the outer coil 21 has rotated $\alpha$ degrees, the magnetic field 54 in the left inner coil 22 will have rotated $\alpha/2$ degrees as shown in FIG. 9. When the $\alpha=90°$, the two fields 54 and 55 are equal and at 45° angles to the plane of the straight central walls 37 and 38. When the angle $\alpha=180°$, the left magnetic field 54 diminishes to 0, and the right magnetic field 55 increases to full strength. Thus a transfer of the location of the magnetic field has been accomplished, with substantially no work being required to rotate the outer coil 21. The new right magnetic field 55 in FIG. 12, however, will be oriented 180° from the direction in which the left magnetic field 54 was oriented in FIG. 8. To return the magnetic field to the left inner coil 22, the outer coil 21 is simply rotated 180° forward or backward so that it is returned to its original position shown in FIG. 8.

Figure 14:
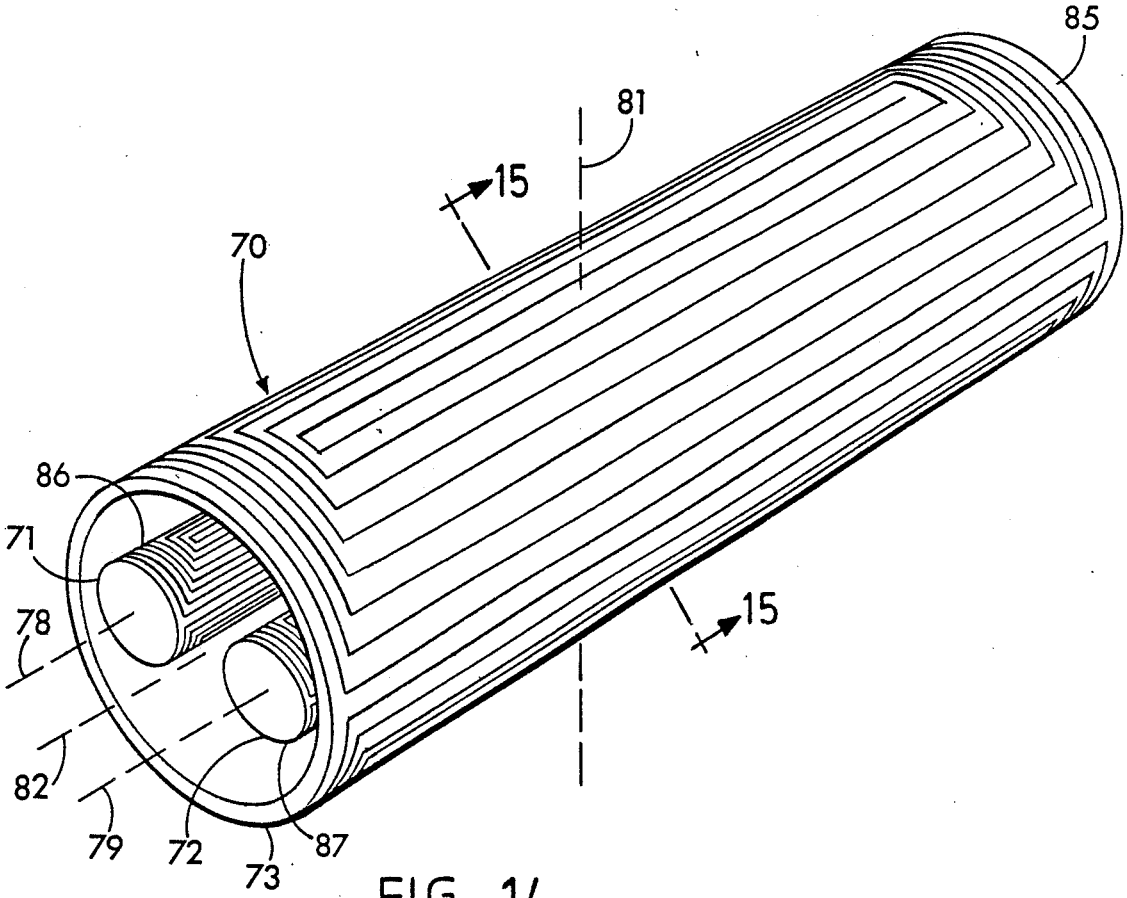
FIG. 14 shows a perspective view of a third magnetic field transfer device of the invention.
Figure 15:
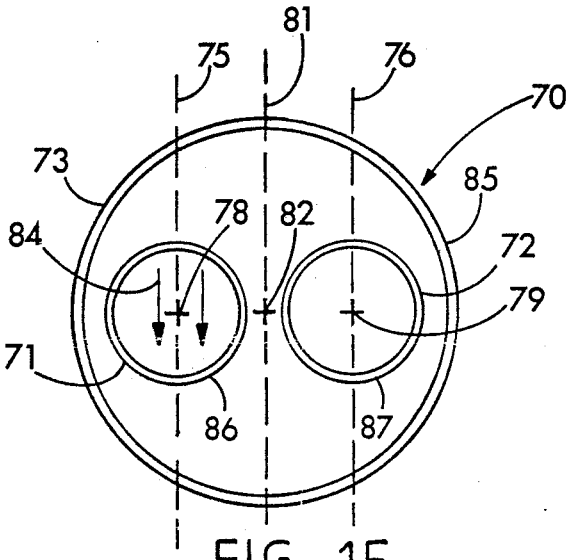
FIG. 15 shows a cross-sectional view of the third magnetic field transfer device taken along the section line 15—15 of FIG. 14.

A third magnetic field transfer device 70 of the invention is shown in FIGS. 14 and 15. The device 70 is similar to the second magnetic field transfer device 20 except that its two inner coils 71 and 72 each have a circular cross-section instead of a D-shaped cross-section. Additionally, since the inner coils 71 and 72 are both circular in cross-section, they do not form a single circular outer surface together. Thus the outer coil 73, which also is circular in cross-section, does not follow the contour of the two inner coils 71 and 72. Instead, the outer coil 73 is spaced outwardly from the inner coils 71 and 72 at varying distances with respect to the two inner coils 71 and 72. In each inner coil 71 and 72, the superconducting windings 86 and 87 are wound around the inner coil axis 75 or 76 to form inner cylinders 71 and 72 which have cylindrical axes 78 and 79. Similarly, the outer coil 73 is comprised of superconducing windings 85 around the outer coil axis 81 to form an outer cylinder 73 with an outer cylindrical axis 82 about which the outer cylinder 73 rotates. When the magnetic fields of the outer coil 73 and the left inner coil 71 are aligned as shown in FIG. 15, an augmented magnetic field 84 is formed in the left inner coil 71, while the field in the right inner coil 72 is cancelled. When the outer coil 73 is rotated 180°, the augmented magnetic field is transferred to the right inner coil 72 and reoriented 180°. The device 70 therefore operates in a manner similar to the second device 20.

Figure 16:
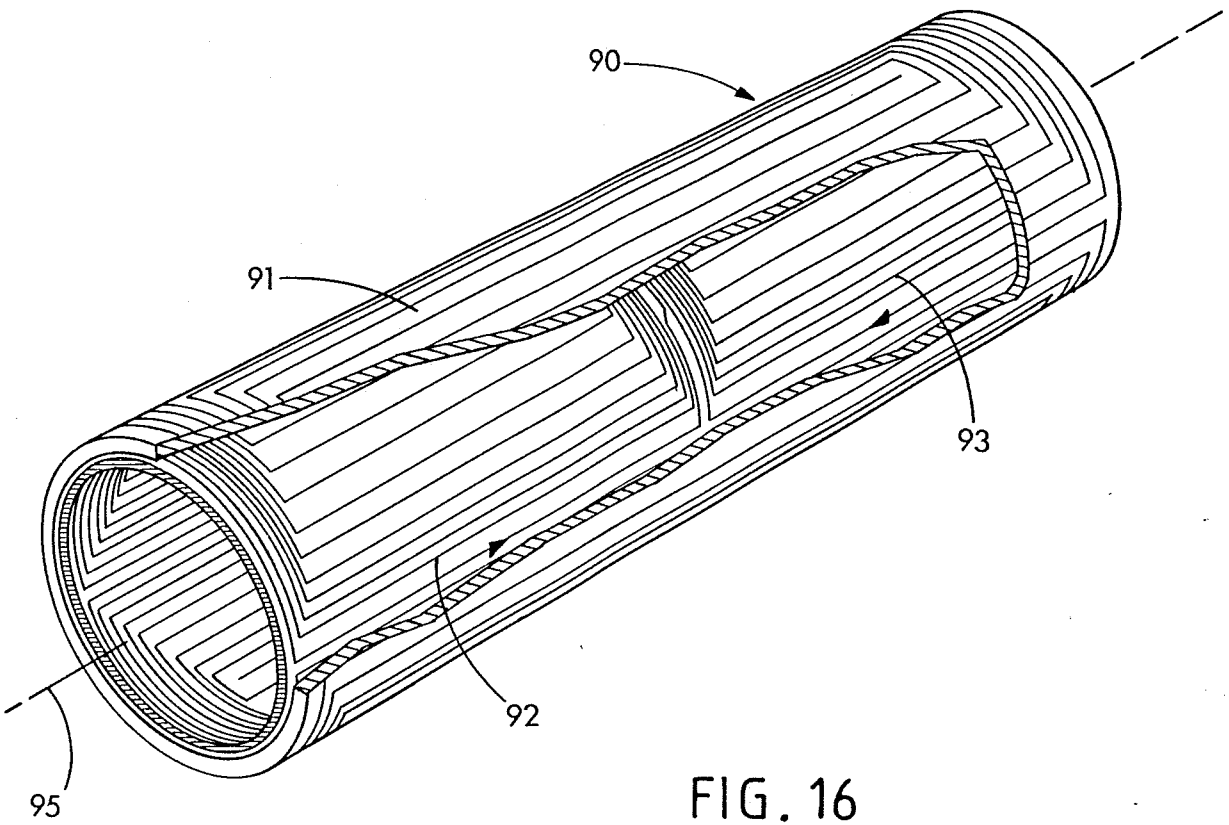
FIG. 16 is a perspective view of a fourth magnetic field transfer device of the invention.

A fourth magnetic field transfer device, somewhat similar in construction to the device 70 is shown generally at 90 in FIG. 16. The device 90 has an outer coil 91, which may be formed identically to the outer coil 73 of the device 70, and two inner coils 92 and 93, both formed as cylinders which are concentric with and closely spaced from the outer cylindrical coil 91. The inner coils 92 and 93 may be formed in an identical manner as the outer coil 91, having equal radius, and lying longitudinally adjacent are another within the outer cylinder. The inner coils are connected together to conduct current in the same manner as the two inner coils 11 and 12 of the device 10 of FIG. 1. Rotation of the outer coil 91 around its cylindrical axis 95 by 180° (or conversely, 180° rotation of the inner coils about the same axis 95) transfers flux from the volume within one of the coils 92 and 93 to the other, in a manner analogous to rotation of the outer coil 13 about the axis y—y as shown in FIG. 3 which transfers flux between the two inner coils 11 and 12 of the device 10.

The magnetic field transfer devices 10, 20, 70 and 90 allow a magnetic field to be transferred between two volumes which are very close to each other, through a process which is reversible and substantially lossless. This process is accomplished with a minimum amount of work since the torque opposing the rotation of the outer coil can be made very small. Although the inner coils 11 and 12 of the first device 10 are rectangular in shape, the inner coils 22 and 23 of the second device 20 are cylinders with D-shaped cross-section, and the inner coils 71 and 72 of the third device 70 and inner coils 92 and 93 of the device 90 are cylinders of circular cross-section, the particular shape of the volumes between which the magnetic field is transferred is not crucial. Additionally, the inner coils and outer coils may be configured to transfer a field which runs in almost any direction. Although the rotational axes 18, 28 and 82 of the outer coils 13, 21, and 73 are positioned between the inner coils and substantially parallel thereto, these rotational axes could be placed in some other position such that they are perpendicular to the inner coil axes 14, 15, 31, 32, 75 and 76.

It is understood that the invention is not confined to the particular embodiments herein illustrated and described but embraces such modified forms thereof as come within the scope of the following claims.

What is claimed is:

1. A magnetic field transfer device comprising:

(a) a pair of oppositely wound inner coils which each include at least one winding around an inner coil axis, the two inner coil axes being substantially parallel and laterally spaced from each other so the inner coils are positioned in side-by-side relation; and (b) an outer coil which includes at least one winding around an outer coil axis, the outer coil being outwardly positioned from said inner coils and rotatable relative to the inner coils about a rotational axis substantially perpendicular to said inner coil axes to generate a hypothetical surface substantially enclosing said inner coils, and thereby moving between a first position wherein the outer coil axis is substantially parallel to said inner coil axes and a magnetic field can be formed within one inner coil parallel to its inner coil axis, and a second position wherein the magnetic field is transferred into the other inner coil and reoriented 180°.

2. The magnetic field transfer device of claim 1 wherein the windings of the inner and outer coils are formed of superconductors.

3. The magnetic field transfer device of claim 1 wherein each inner coil forms an inner cylinder with an inner cylindrical axis perpendicular to the inner coil axis, and the windings of the inner coils are wound to run substantially in two opposite directions parallel to the inner cylindrical axis.

4. The magnetic field transfer device of claim 3 wherein the inner cylinders each include a straight central wall formed of the windings running in a first direction parallel to the inner cylindrical axis and a curved outer wall formed of the windings running in an opposite direction parallel to the inner cylindrical axis such that each inner cylinder is D-shaped in cross-section, the windings in the central wall and outer wall of each inner cylinder being joined together at ends of each inner cylinder so that the windings forming each inner cylinder are continuous.

5. The magnetic field transfer device of claim 4 wherein the straight inner walls of the two inner cylinders are adjacent to each other so that a circular outer surface is formed by the two curved outer walls together.

6. The magnetic field transfer device of claim 1 wherein the outer coil forms an outer cylinder with an outer cylindrical axis perpendicular to the outer coil axis, and the windings are wound to run substantially in two opposite directions parallel to the outer cylindrical axis.

7. The magnetic field transfer device of claim 6 wherein the outer cylinder includes two substantially semi-cylindrical walls, one semi-cylindrical wall formed of the windings running in a first direction parallel to the outer cylindrical axis and the second semi-cylindrical wall formed of the windings running in an opposite direction parallel to the outer cylindrical axis.

8. The magnetic field transfer device of claim 7 wherein the outer cylindrical axis is parallel to the inner cylinder axes, the outer coil includes an inner surface which is nearly adjacent to and facing an outer surface of the two inner coils, and the axis of rotation substantially coincides with the outer cylindrical axis.

9. The magnetic field transfer device of claim 8 wherein the semi-cylindrical walls have a thickness proportional to cos $\theta$, wherein $\theta$ is an angle formed between a point on one semi-cylindrical wall and a midpoint of that semi-cylindrical wall with respect to the outer cylinder axis.

10. The magnetic field transfer device of claim 3 wherein the inner cylinders are circular in cross-section with the windings which run in two opposite directions substantially parallel to the inner cylindrical axis.

11. The magnetic field transfer device of claim 1 wherein the pair of inner coils comprise two equal coplanar inner loops which are electrically connected together so that any current, if any, which moves in a rotational direction around one inner loop moves in an opposite rotational direction around the other inner loop, so that substantially no current is induced in the inner loops when any external magnetic field in which the inner coils lie has equal magnetic fluxes linked with both inner loops.

12. The magnetic field transfer device of claim 11 wherein the outer coil is an outer loop which is rotatable with relation to the two coplanar inner loops between two 180° apart positions in which the outer loop is coplanar with the inner loops.

13. The magnetic field transfer device of claim 6 wherein the two inner coils form inner cylinders lying longitudinally adjacent one another and having the same cylindrical axes as the outer coil cylindrical axis.

14. A method of transferring a magnetic field comprising the steps of:

(a) providing a pair of oppositely wound inner coils which each include at least one winding around an inner coil axis, and which are positioned in side-by-side relation so that the two inner coil axes are substantially parallel and spaced laterally from each other;

(b) providing an outer coil which includes at least one winding around an outer coil axis, wherein dimensions of the outer coil are sufficient to encircle the two inner coils when rotated;

(c) positioning the pair of inner coils and the outer coil in relation to each other such that when the pair of inner coils and the outer coil are rotated relative to each other along a rotational axis substantially perpendicular to the inner coil axes, the pair of inner coils are substantially confined within the outer coil;

(d) providing the pair of inner coils with electrical current which moves around the inner coils in opposite rotational directions around the inner coil axes;

(e) providing the outer coil with electrical current which moves around the outer coil in the same rotational direction as the electrical current moves in a first of the inner coils when the outer coil axis is parallel with the inner coil axes so that a magnetic field formed in the first inner coil is augmented by a magnetic field formed by the outer coil, and a magnetic field formed in the second of the inner coils is diminished by the magnetic field formed by the outer coil; and (f) rotating the pair of inner coils and outer coil relative to each other 180° around the rotational axis so that the magnetic field formed by the outer coil augments the magnetic field formed within the second inner coil and diminishes the magnetic field in the first inner coil.

15. The method of claim 14 wherein when the outer coil axis is parallel to the inner coil axes, the magnetic field of one inner coil is augmented by a factor of two, and the magnetic field of the other inner coil is diminished substantially to zero, so that when the pair of inner coils and the outer coil then rotate 180° with respect to each other so that the coil axes are again parallel, the magnetic field of the one inner coil is then diminished substantially to zero and the magnetic field of the other inner coil is augmented by a factor of two, thereby transferring the augmented magnetic field from one inner coil to the other inner coil.

* * * * *